US007696945B2

(12) United States Patent
Svensson et al.

(10) Patent No.: US 7,696,945 B2
(45) Date of Patent: Apr. 13, 2010

(54) SCANNABLE SPARSE ANTENNA ARRAY

(75) Inventors: Bengt Svensson, Mölndal (SE); Kent Falk, Mölnlycke (SE); Ulrika Engström, Göteborg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/580,611

(22) PCT Filed: Nov. 27, 2003

(86) PCT No.: PCT/SE03/01843

§ 371 (c)(1),
(2), (4) Date: Mar. 28, 2007

(87) PCT Pub. No.: WO2005/053097

PCT Pub. Date: Jun. 9, 2005

(65) Prior Publication Data

US 2007/0273603 A1 Nov. 29, 2007

(51) Int. Cl.
*H01Q 13/10* (2006.01)
*H01Q 21/00* (2006.01)

(52) U.S. Cl. ..... 343/844; 343/771; 343/770

(58) Field of Classification Search ..... 343/844, 343/770, 776, 771, 772, 754
See application file for complete search history.

(56) References Cited

U.S. PATENT DOCUMENTS 3,697,993 A * 10/1972 Jones et al. ..... 342/161
3,848,256 A * 11/1974 Craven et al. ..... 343/768
4,104,641 A * 8/1978 Unz ..... 343/844
4,415,902 A * 11/1983 Redlich ..... 343/844
4,788,552 A * 11/1988 Karlsson ..... 343/771
5,579,019 A * 11/1996 Uematsu et al. ..... 343/771

(Continued)

FOREIGN PATENT DOCUMENTS

CN 1373918 9/2002

(Continued)

OTHER PUBLICATIONS

International Search Report for PCT/SE2003/001843 dated Jun. 23, 2004.

(Continued)

*Primary Examiner*—Douglas W Owens
*Assistant Examiner*—Jennifer F Hu
(74) *Attorney, Agent, or Firm*—Nixon & Vanderhye P.C.

(57) ABSTRACT

A sparse array antenna is disclosed. The antenna comprises series-fed antenna array columns tuned to a respective transmit and receive frequency. The transmitting and receiving radiation elements are formed with a given distance between each transmitting radiator element and each receiving radiator element, and the series-fed antenna columns are arranged in parallel, perpendicular to a symmetry line forming a symmetric interleaved transmit/receive array. Furthermore the receiving array columns operate as parasitic elements in a transmit mode and transmitting array columns operate as parasitic elements in a receive mode, thereby reducing creation of grating lobes. The created sparse array antenna may further be arranged to be scannable to also provide reduced sidelobes entering visual space when scanning the main radiation lobe from an off boresight direction. Typically the series-fed array columns may be formed as extended ridged slotted wave-guides tuned to a respective transmitting or receiving frequency.

8 Claims, 10 Drawing Sheets

U.S. PATENT DOCUMENTS

| | | | | |
|---|---|---|---|---|
| 5,638,079 | A * | 6/1997 | Kastner et al. | 343/770 |
| 5,859,616 | A * | 1/1999 | Gans et al. | 343/700 MS |
| 6,127,985 | A * | 10/2000 | Guler | 343/771 |
| 6,351,243 | B1 | 2/2002 | Derneryd et al. | |
| 6,351,244 | B1 * | 2/2002 | Snygg et al. | 343/771 |
| 6,509,881 | B2 | 1/2003 | Falk | |
| 6,535,173 | B2 * | 3/2003 | Ou | 343/770 |
| 6,922,177 | B2 * | 7/2005 | Barnes et al. | 343/893 |
| 7,023,393 | B2 * | 4/2006 | Ishii et al. | 343/771 |
| 7,202,832 | B2 * | 4/2007 | Wang | 343/771 |
| 2001/0031648 | A1 * | 10/2001 | Proctor et al. | 455/562 |
| 2002/0003502 | A1 * | 1/2002 | Falk | 343/771 |
| 2005/0219134 | A1 * | 10/2005 | Sergey | 343/770 |
| 2006/0114165 | A1 * | 6/2006 | Honda et al. | 343/785 |
| 2006/0132374 | A1 * | 6/2006 | Wang | 343/770 |
| 2006/0164315 | A1 * | 7/2006 | Munk | 343/776 |

FOREIGN PATENT DOCUMENTS

| | | | |
|---|---|---|---|
| EP | 159301 | A1 * | 10/1985 |
| WO | WO 2005053097 | A1 * | 6/2005 |

OTHER PUBLICATIONS

Translation of Chinese official action, Jul. 3, 2009, in corresponding Chinese Application No. 200380110745.3.

* cited by examiner

SCANNABLE SPARSE ANTENNA ARRAY

This application is the a new U.S. patent application claiming priority to PCT/SE2003/001843 filed 27 Nov. 2003, the entire content of which is hereby incorporated by reference.

TECHNICAL FIELD

The present invention relates to an antenna array presenting a sparse antenna design, which also provides scanning with reduced grating lobes.

BACKGROUND

The demand for increased capacity in the area covering communication networks can be solved by the introduction of array antennas. These antennas are arrays of radiating elements that can create one or more narrow beams in the azimuth plane. A narrow beam is directed or selected towards the client of interest, which leads to a reduced interference in the network and thereby increased capacity. In U.S. Pat. No. 6,509,881 an interleaved single aperture simultaneous Rx/Tx antenna is disclosed.

A number of simultaneous fixed scanned beams may be generated in the azimuth plane by means of a Butler matrix connected to the antenna columns. The antenna element spacing is determined by the maximum scan angle as the creation of interference lobes due to repeated constructive adding of the phases (also referred to as grating lobes) must be considered. In order to scan a phased array antenna, the element positions must be small enough to avoid grating lobes. For an element distance of 1λ the grating lobe will appear at the edge of the visible space (non-scanning condition). If the beam then is scanned off boresight, the grating beam will move into the visible space.

Thus, a problem in designing antennas is that the radiating elements in an array antenna have to be spaced less than one wavelength apart in order not to generate troublesome grating (secondary) lobes and in the case of a scanned beam, the spacing has to be further reduced. In the limit case when the main beam is scanned to very large angles (as in the case of an adaptive antenna for mobile communications base stations), the element separation needs to be reduced to half a wavelength or less to avoid generation of grating lobes within visible space. Thus it can as a general rule be established that an antenna array with a fixed lobe should normally have an element distance of less than 1 wavelength while an antenna array with a scanable lobe should normally have an element distance of less than half a wavelength for obtaining a proper scanning angle range.

As disclosed in U.S. Pat. No. 6,351,243, radiating elements in an array antenna are often placed in a regular rectangular grid as illustrated in FIG. 1. The element spacing is denoted $d_x$ along the x-axis and $d_y$ along the y-axis. The beam directions are found by transforming from element space to beam space. The corresponding beam space for the antenna illustrated in FIG. 1 is found in FIG. 2.

In this case the main beam is pointing in the direction along the antenna normal. The beams outside the visible space (i.e. outside the unit circle) constitute grating lobes and they do not appear in visible space as long as the beam is not scanned and the element spacing is less than one wavelength along both axes ($\lambda/d_x>1$ and $\lambda/d_y>1$). For a large array, the number of radiating elements in the rectangular arranged grid is approximately given by $N_R=A/(d_x d_y)$, where A is the area of the antenna aperture.

When the main beam is scanned along the x-axis, all beams in beam space move in the positive direction by an amount, which equals a function expressed as sinus of the scan (radiating) angle. For each horizontal row in a one-dimensional scan in the x-direction we can express secondary maxima or grating lobes as $$x_m = \sin(\theta_s) + m \cdot \frac{\lambda}{d_x},\ m = \pm 1, \pm 2,$$

wherein $x_m$ is the position of lobe m, $\theta_s$ is the scan angle relative to the normal of the array and $d_x$ is the distance between the elements in the horizontal plane. As the distance between lobes here is $\lambda/d_x$ it will be realised that the largest element distance for a scan angle producing no grating lobes within the visible region is $$\frac{d}{\lambda} < \frac{1}{1+\sin(\theta_{max})}$$

In a case illustrated in FIG. 3, a second beam (grating lobe) enters visible space in addition to the main beam. This may be avoided by reducing the element spacing along the x-axis. When the element spacing is less than half a wavelength (i.e. $\lambda/d_x>2$), no grating lobe will enter visible space independent of scan angle, since $|\sin(\theta)|\leqq 1$.

Radiating elements placed in an equilateral triangular grid are shown in FIG. 4. The vertical element spacing is defined as $d_y$. A corresponding beam space is illustrated in FIG. 5. The element spacing must not be greater than $1/\sqrt{3}$ wavelengths (i.e. a maximum value of $d_y$ is about 0.58 wavelengths) along the y-axis (and $2d_x$ is one wavelength along the x-axis [equal to $d_y\sqrt{3}=0.58\cdot\lambda\cdot\sqrt{3}=\lambda$]) to avoid generating grating lobes for any scan angle. Thus the optimum element spacing, $d_y$, in an equilateral triangular grid of radiating elements is $1/\sqrt{3}$ wavelengths. For a large array, the number of radiating elements in the triangular arranged grid is approximately given by $N_T=A/(2d_x d_y)$. (Also see reference E. D. Sharp mentioned above.) A reduction of $(N_R-N_T)/N_R=13\%$ is obtainable for the equilateral triangular grid compared to the square grid assuming the same grating lobe free scan volume. ($N_T=4A/\lambda^2$ and $N_R=2A\sqrt{3}/\lambda^2$.)

However there is still a demand for an optimisation of the radiating grid in an array antenna for obtaining a scanning sparse antenna array, which provides a further suppressing of grating lobes within visible space.

SUMMARY

A sparse array antenna is disclosed and comprises series-fed antenna array columns (wave-guides or other types of transmission lines forming columns of radiator elements) tuned to a respective transmit and receive frequency. Transmitting and receiving radiation elements are formed with an equal distance between each transmitting radiator element and each receiving radiator element being centred on a symmetry line to form a symmetric interleaved transmit/receive array. The receiving array columns will operate as parasitic elements in a transmit mode and the transmitting array columns will operating as parasitic elements in a receive mode and thereby reduce grating lobes entering visual space particularly when scanning the main radiation lobe off from a boresight direction. Generally the distances between each array column in the transmitting array and each array column in the receiving array are increased to be of the order of one wavelength (λ) for forming a sparse array.

SHORT DESCRIPTION

DETAILED DESCRIPTION OF THE INVENTION

For purposes of illustration only, a 2 (Rx)+2 (Tx) wave-guide test model will be described. The goal is then to demonstrate the performance of an interleaved antenna and the correspondence to simulated results. The design of this test model will be described.

The Test model centre frequencies were chosen to be:

$f_{RX}$=5.671 GHz $f_{TX}$=5.538 GHz

The slot length and displacement for the slots were calculated using an analysis program for wave-guide slit antennas. The slot length and displacement were set to be equal for all slots within each frequency band function.

The slot parameters were changed and analysed until the input impedance of each wave-guide was matched. The two unexcited wave-guides were also present in the calculation.

The final design parameters are shown below:

$f_{RX}$=5.671 GHz (centre frequency)

$f_{TX}$=5.538 GHz $\lambda_{g_Rx}$=82.84 mm (guide wavelength)

$\lambda_{g_Tx}$=87.99 mm $dx_{Rx}=\lambda_{g_Rx}/2$=41.42 mm (element distance)

$dx_{Tx}=\lambda_{g_Tx}/2$=43.995 mm dy=51.26 mm (Wave-guide separation within each band, equal for both Rx & Tx arrays)

$N_{Rx}$=26 (number of elements/slots within each waveguide)

$N_{Tx}$=24 (number of elements/slots within each waveguide)

Slot width W=3.00 mm

The slot data design was made for the active wave-guides fed by equal amplitude and phase. The passive wave-guides (the "other" band) were matched at the feed port.

The slot data obtained are shown in Table I:

TABLE I

Wave-guide slot data

| Vgl # | Slot displacement d (mm) | Slot length L (mm) | Calculated wave-guide impedance at centre freq. | Wave-guide height position (mm) | Slot separation along wave-guide (mm) | Rx/Tx - wave-guide |
|---|---|---|---|---|---|---|
| 1 | 0.67 | 28.90 | 0.97 − j0.06 | 38.445 | 41.42 | Rx |
| 2 | 0.67 | 29.50 | 1.01 + j0.04 | 12.815 | 43.995 | Tx |
| 3 | 0.67 | 28.90 | 1.03 + j0.04 | −12.815 | 41.42 | Rx |
| 4 | 0.67 | 29.50 | 0.97 − j0.07 | −38.445 | 43.995 | Tx |

Figure 1:
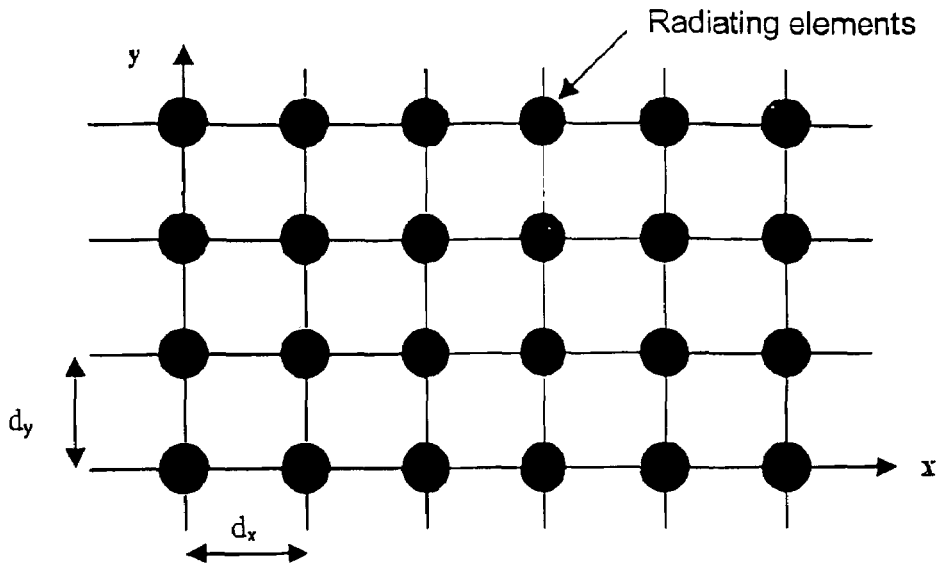
Fig. 1 (PRIOR ART)
FIG. 1 illustrates an antenna having radiating elements placed in a rectangular grid.
Figure 2:
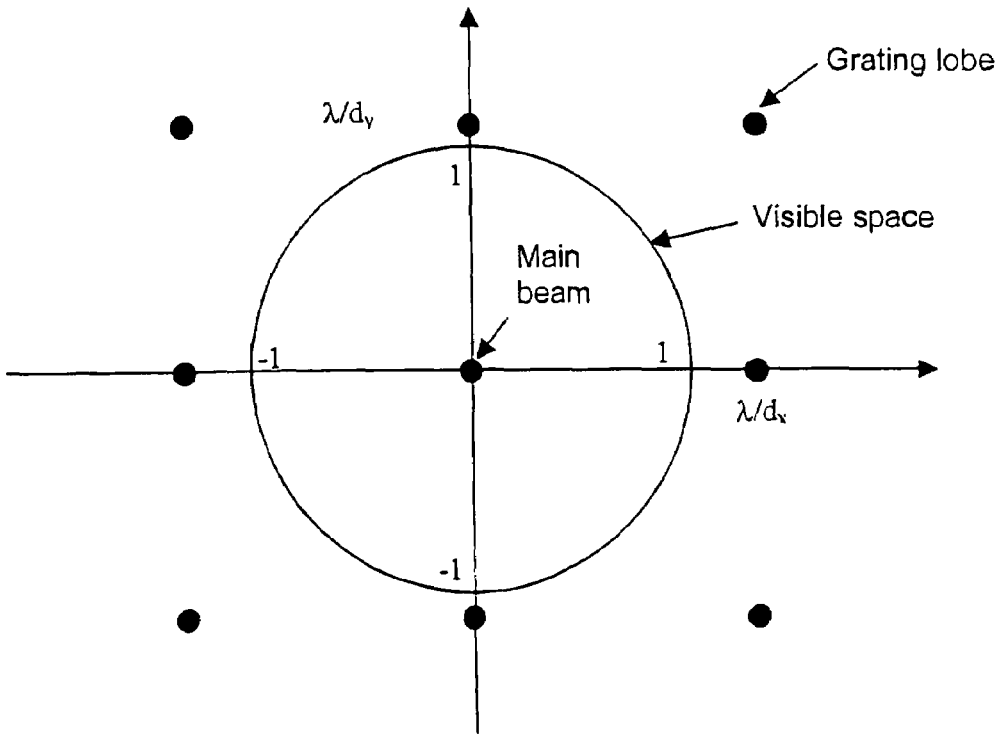
Fig. 2 (PRIOR ART)
FIG. 2 illustrates beam space for an array demonstrated in FIG. 1.
Figure 3:
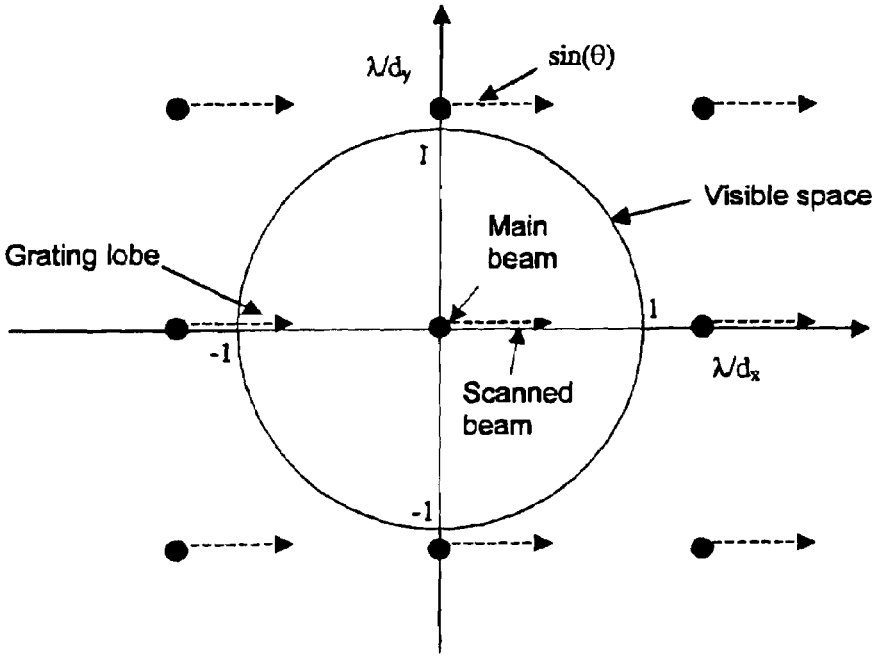
Fig. 3 (PRIOR ART)
FIG. 3 illustrates the beam space for the antenna illustrated in FIG. 1 when the main beam is scanned along the x-axis.
Figure 4:
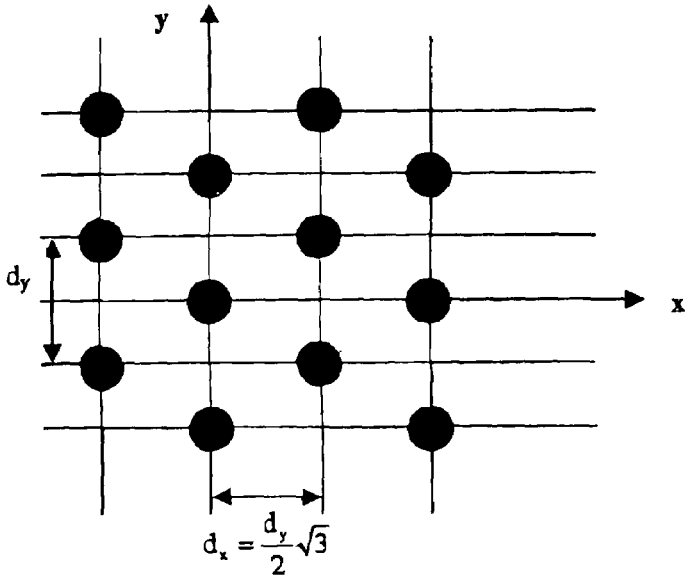
Fig. 4 (PRIOR ART)
FIG. 4 illustrates an antenna having radiating elements in an equilateral triangular grid.
Figure 5:
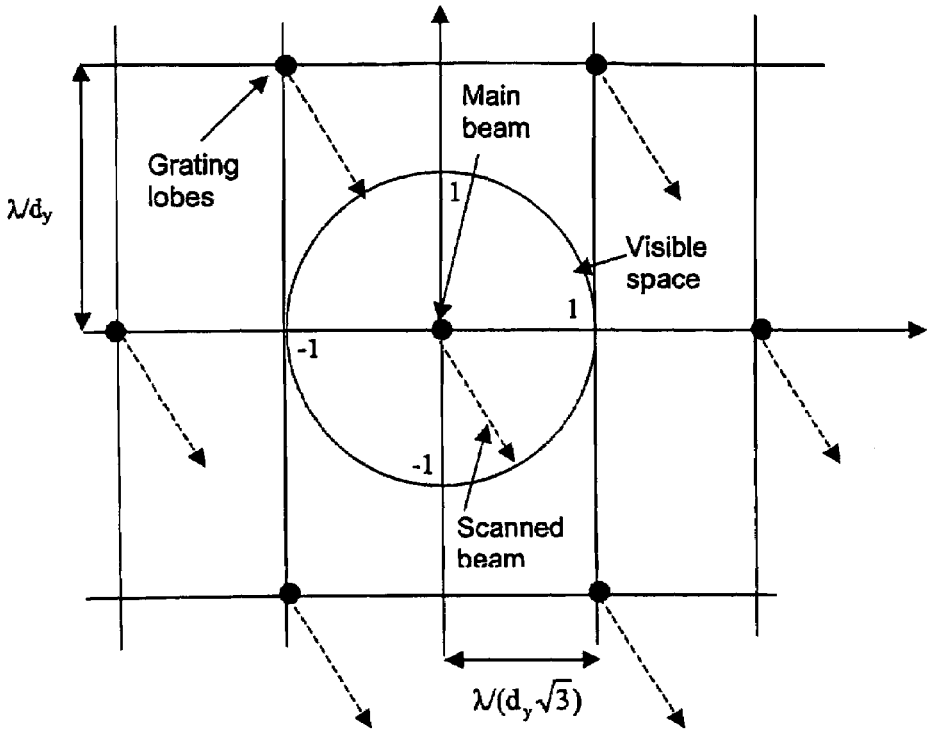
Fig. 5 (PRIOR ART)
FIG. 5 illustrates the beam space for an equilateral triangular grid with no grating lobes in visible space.
Figure 6:
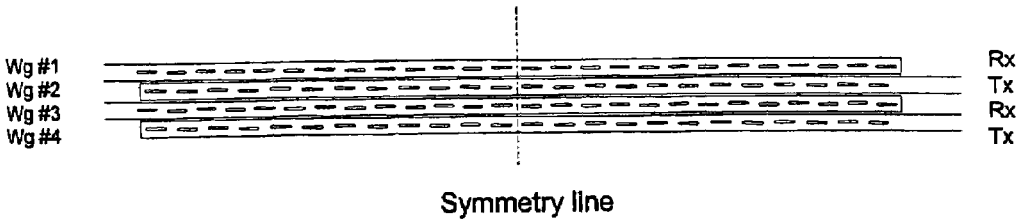
FIG. 6 illustrates a set of wave-guides for Tx and Rx arranged symmetrically around a line through the centre of each wave-guide.

FIG. 6 illustrates, in an illustrative embodiment, a set of interleaved wave-guides for transmission and reception. The wave-guides are here arranged symmetrically around a line through the centre of the extension of each wave-guide. Each wave-guide further comprises a number of slots n in each slotted transmitting wave-guide, while each slotted receiving wave-guide may have n±x slots, where x then represents an integer digit, (e.g. 0, 1, 2, 3 . . . ). Such an array may typically be fed by means of active T/R-modules in order to reduce number of modules and consequently reduced cost.

Simulations

The simulated input impedance has been shown for centre frequency in the table above. From these simulations, the excitation ("slot field" amplitude and phase) was also extracted. This was used to calculate the antenna far field for the two main cuts, H- and E-plane. The "non-fed" wave-guides are terminated in a matched load. An antenna element model simulating a slot in a finite ground plane was used.

Figure 7:
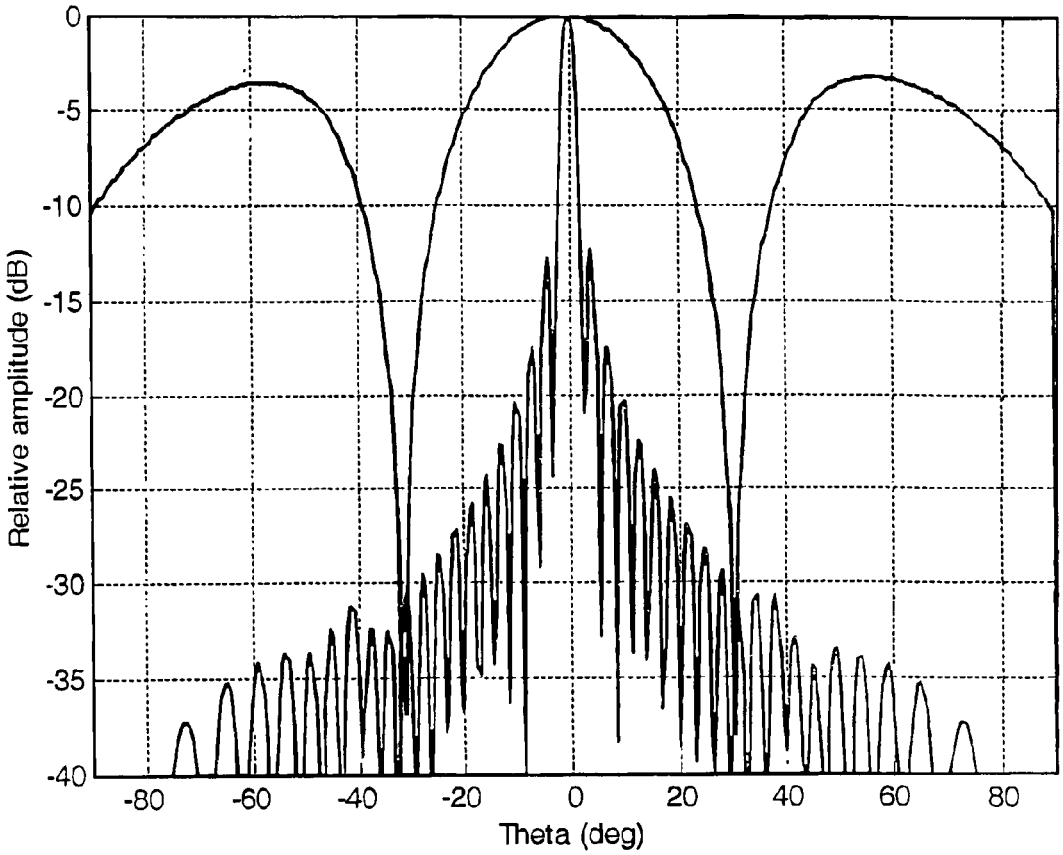
FIG. 7 illustrates radiation pattern for Test wave-guide, Rx-feed, f=5.671 GHz.
Figure 8:
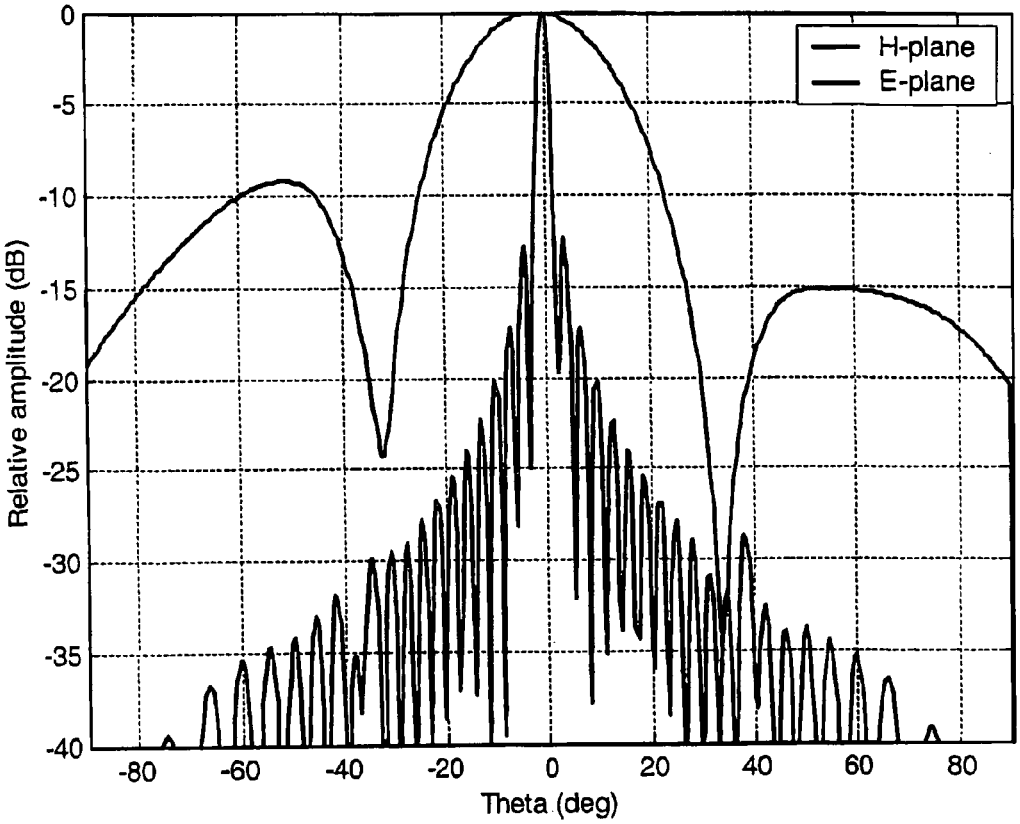
FIG. 8 illustrates radiation pattern for the Test wave-guide, Rx-feed, f=5.671 GHz and Tx antenna element excitations cleared.

FIG. 7 shows the radiation pattern when the Rx-wave-guides are fed with equal amplitude and phase. The corresponding case but with the Tx-excitations cleared (set equal to 0) is shown in FIG. 8. It can be observed that for the two wave-guides alone for Rx, (FIG. 7) grating lobes will appear in the E-plane since the wave-guide distance is close to 1λ. These lobes will be suppressed when the Tx wave-guides are present and parasitically excited, as illustrated in FIG. 8.

Figure 9:
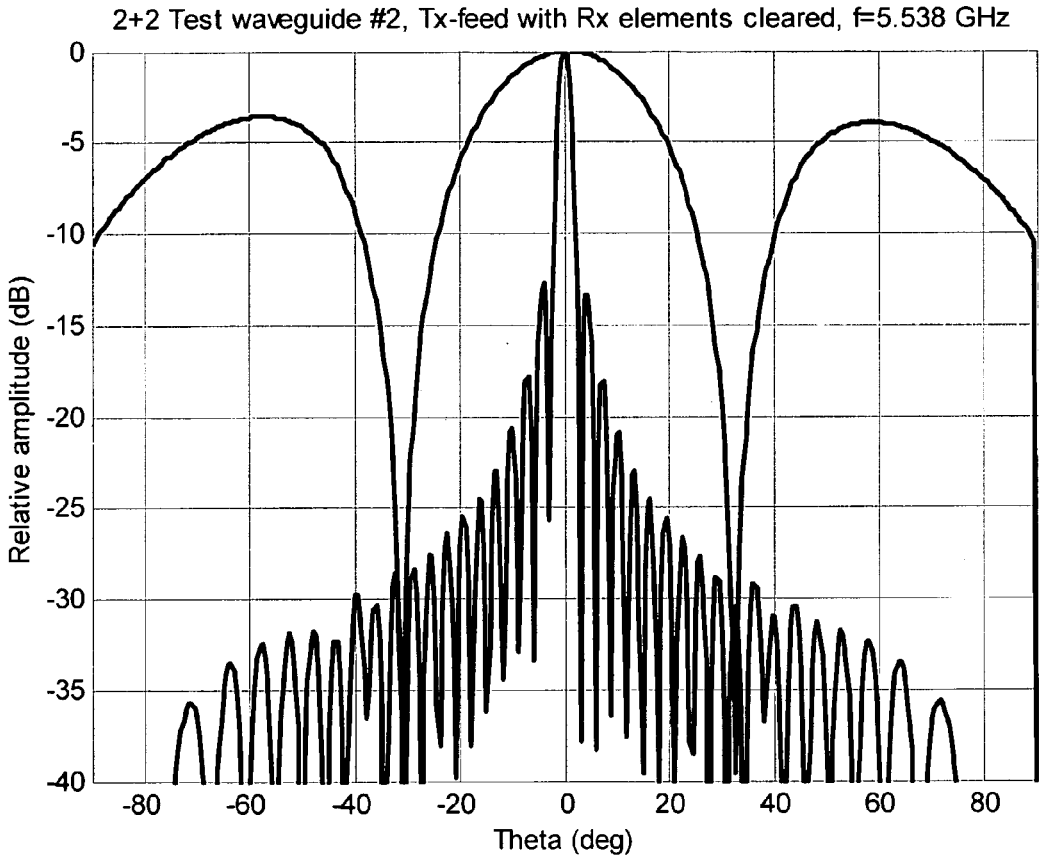
FIG. 9 illustrates radiation pattern for the Test wave-guide, Tx-feed, f=5.538 GHz.
Figure 10:
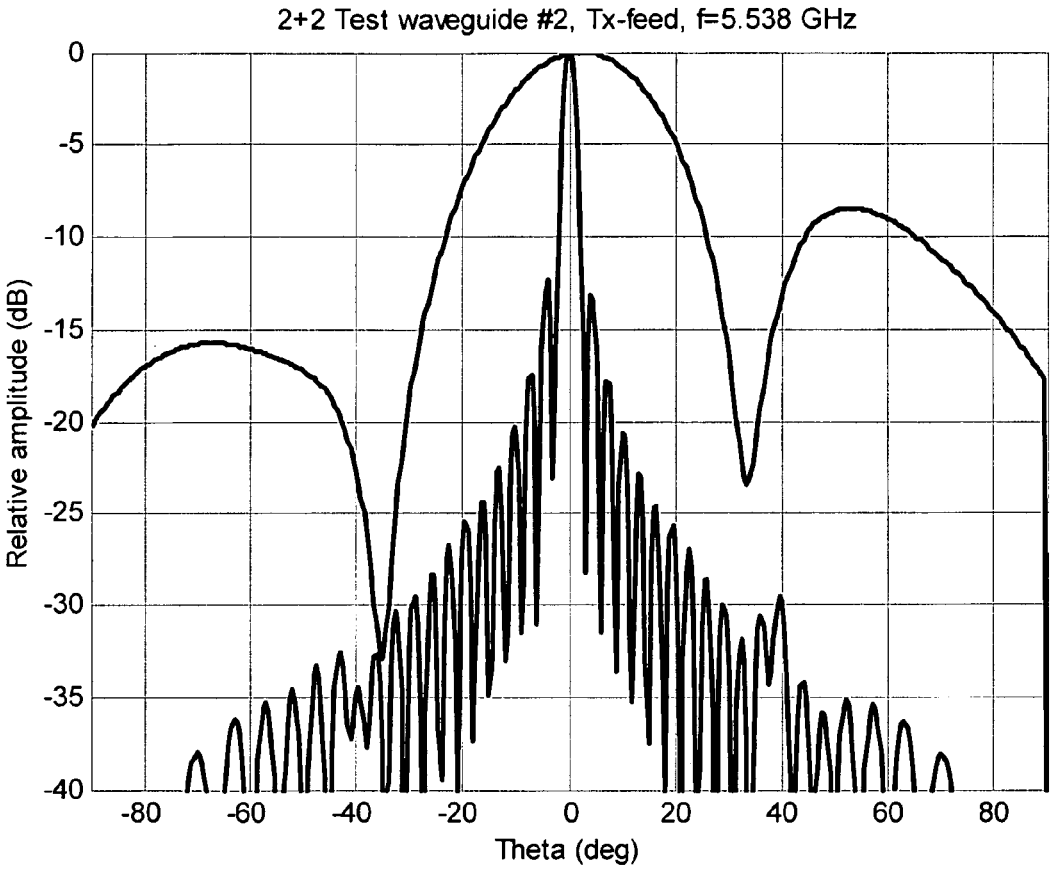
FIG. 10 illustrates radiation pattern for the Test wave-guide, Tx-feed, f=5.538 GHz and Rx antenna element excitations cleared.

The corresponding cases when the Tx wave-guides are fed with equal amplitude and phase are shown in FIG. 9 and FIG. 10.

Simulation of Four Element Scanning Array

Figure 11:
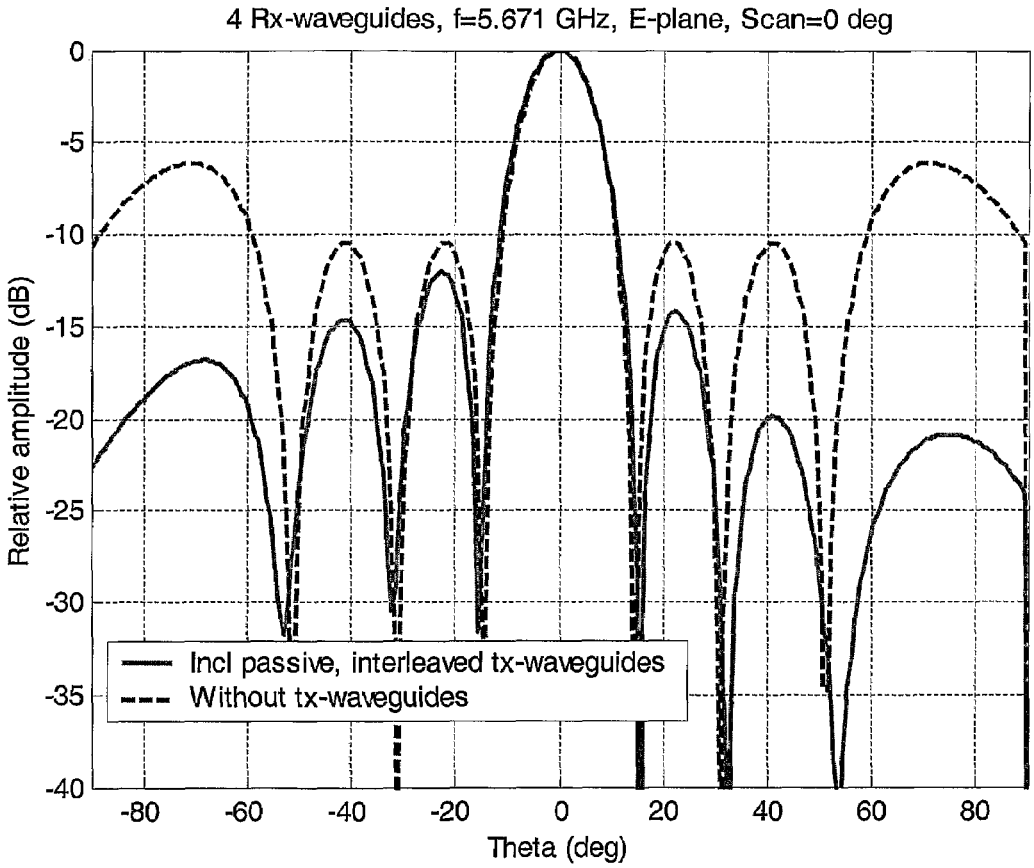
FIG. 11 illustrates radiation pattern for four Rx-wave-guides with/without passive, interleaved Tx wave-guides, f=5.671 GHz, E-plane, Scan=0°.
Figure 12:
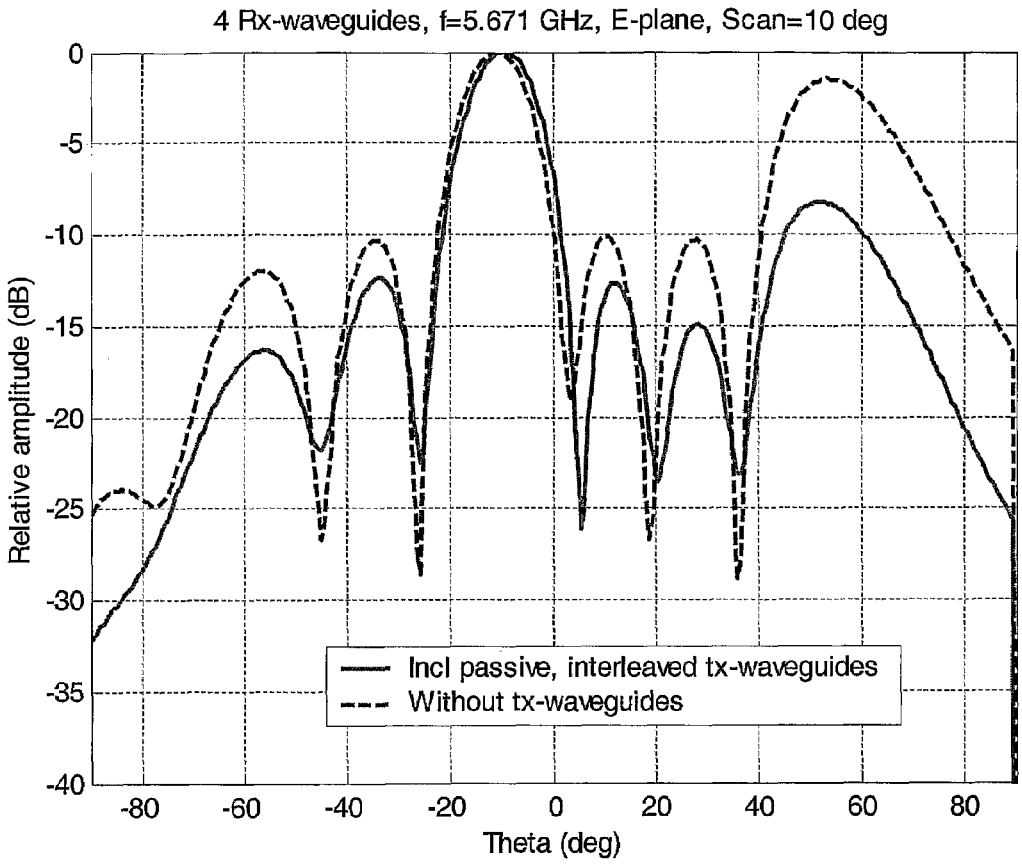
FIG. 12 illustrates radiation pattern for four Rx-wave-guides with/without passive, interleaved Tx wave-guides, f=5.671 GHz, E-plane, Scan=10°.
Figure 13:
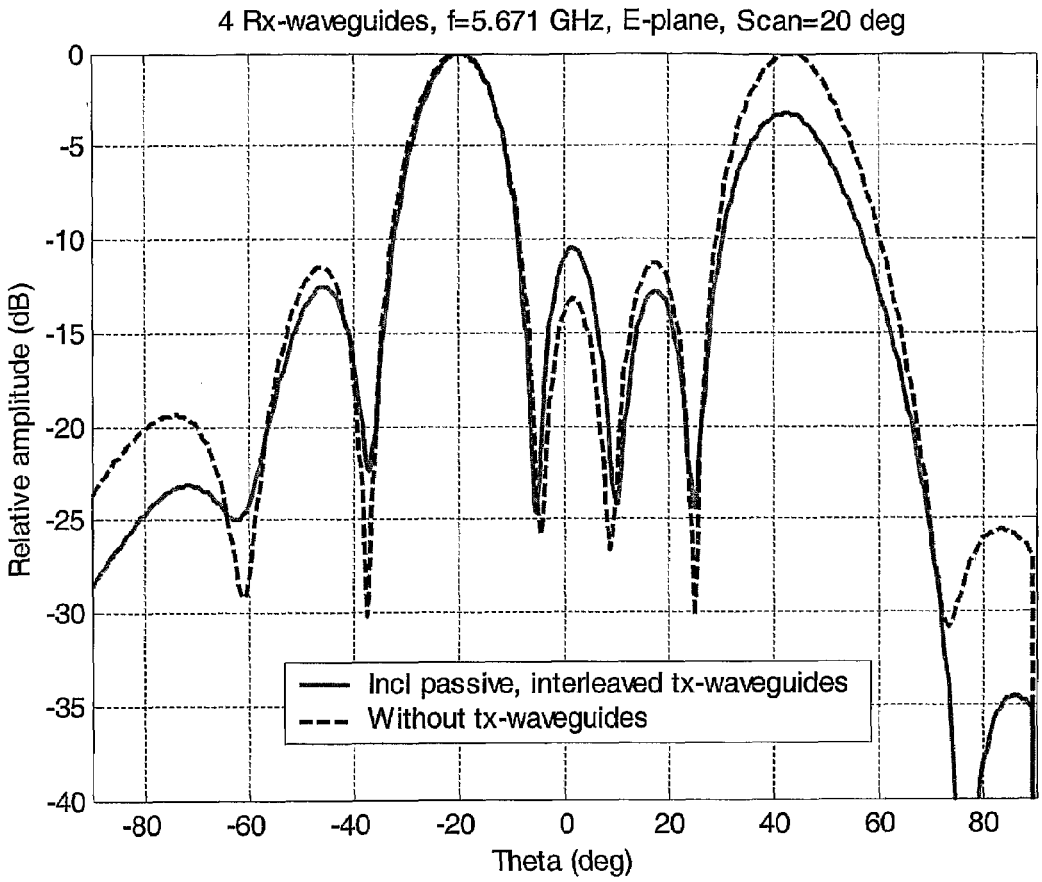
FIG. 13 illustrates radiation pattern for four Rx-wave-guides with/without passive, interleaved Tx wave-guides, f=5.671 GHz, E-plane, Scan=20°.

A simulation of a 4+4 element scanning array was also performed. The input impedance and radiation pattern was calculated at the Rx centre frequency, 5.671 GHz for the E-plane scan angles 0°, 10° and 20°. The simulation was made both with and without passive (terminated with a matched load), interleaved Tx wave-guides. The resulting radiation patterns are shown in FIG. 11 to FIG. 13. The wave-guide parameters are identical to the data shown in Table I above.

In a basic configuration example of a sparse array, the inactive wave-guides, i.e., receive wave-guides in a transmit operation and vice versa, could be given a favorable phase such that the sidelobe level will be decreased. When the array is scanned to a radiation angle off boresight an improvement will also be obtained by using such a technique and in both cases the array will became sparse compared to the standard case, thus a more simple and cheaper antenna having fewer active modules in an Active Electronically Scanned Array (AESA) achieved.

In a more simple but still example version, inactive elements can, for that particular moment, just serve as dummy elements interleaved between the active element by then being terminated in a suitable way. For instance, a suitable shorting device or a matched load positioned at the proper position could then be used.

In a preferred embodiment of this sparse antenna configuration the idea is further based of having several pairs of long serial-fed transmission lines (not necessarily wave-guides) with many radiation elements connected in series and where the distances between the radiation elements of a transmit/receive pair can be somewhat different for the transmitting and receiving radiators, respectively. This will imply that a pair of antenna array columns become tuned to somewhat different frequencies and consequently very little power is coupled between their ports. Such series-fed antenna columns are thus for instance fed from a transmit/receive active module.

In another embodiment of the interleaved antenna array each radiator element of the respective series-fed antenna columns is narrowly tuned within a respective frequency band to thereby further reduce coupling between the transmitting and receiving frequency bands.

In still further embodiment only one set of series-fed columns are actively used, while the remaining set of interleaved set of series-fed columns are terminated by means of a suitable load. This could be used for an entirely tranceive type of operation using a common transmit/receive frequency.

It will be understood by those skilled in the art that various modifications and changes could be made to the present invention without departure from the spirit and scope thereof, which is defined by the appended claims.

The invention claimed is:

1. A sparse array antenna comprising series-fed antenna array columns comprising transmitting array columns and receiving array columns tuned to a respective transmit and receive frequency, each transmitting array column having multiple transmitting radiator elements and each receiving array column having multiple receiving antenna elements, wherein:

said transmitting array columns are formed with a given distance between each one of the transmitting radiator elements, and a distance between each transmitting array column in the array antenna is one wavelength of the transmitting frequency, and said receiving array columns are formed with a given distance between each one of the receiving radiator elements, and a distance between each receiving array column in the array antenna is one wavelength of the receiving frequency, and the series-fed antenna columns being arranged in parallel to each other, thereby forming a symmetric interleaved transmit/receive array;

receiving radiator elements in the receiving array columns operate as parasitic elements in a transmit mode and transmitting radiator elements in the transmitting array columns operate as parasitic elements in a receive mode to reduce creation of grating lobes, wherein the sparse array antenna includes a main radiation lobe and is arranged to be scannable in more than one direction to reduce sidelobes entering visual space when scanning the main radiation lobe from an off boresight direction.

2. The antenna according to claim 1, wherein the series-fed array columns are formed as extended ridged slotted wave-guides, comprising slotted transmitting wave-guides and slotted receiving wave-guides, tuned to said respective transmitting and receiving frequency.

3. The antenna according to claim 2, wherein when having number n of slots in each slotted transmitting wave-guide the number of slots in each slotted receiving wave-guide being generally n±x, where x represents an integer digit (x=0, 1, 2, 3 . . . ).

4. The antenna according to claim 1, wherein the series-fed array columns are formed as extended transmission lines containing radiation elements, the array columns being tuned to said respective transmitting and receiving frequency.

5. The antenna according to claim 1, wherein each one of the series-fed antenna columns is narrowly tuned within a respective frequency band to thereby reduce coupling between the transmitting and receiving bands used.

6. The antenna according to claim 1, wherein the series-fed antenna array columns are connectable to and feedable from an active receive/transmit (T/R) module.

7. The antenna according to claim 1, wherein only one set of series-fed columns being actively used and another interleaved set of series-fed columns may be terminated by a load forming parasitic columns of the sparse array antenna.

8. The antenna according to claim 1, wherein said wave-guides are arranged symmetrically about a line that extends through a center of each wave-guide.

* * * * *

UNITED STATES PATENT AND TRADEMARK OFFICE

CERTIFICATE OF CORRECTION

PATENT NO. : 7,696,945 B2
APPLICATION NO. : 10/580611
DATED : April 13, 2010
INVENTOR(S) : Svensson et al.

It is certified that error appears in the above-identified patent and that said Letters Patent is hereby corrected as shown below:

In Column 1, Line 3, delete "the a" and insert -- a --, therefor.

In Column 1, Line 49, delete "scanable" and insert -- scannable --, therefor.

In Column 3, Line 55, after "DETAILED DESCRIPTION" delete "OF THE INVENTION".

Signed and Sealed this

Fourteenth Day of September, 2010

David J. Kappos

David J. Kappos
*Director of the United States Patent and Trademark Office*